US006047961A

United States Patent [19]

Becker et al.

[11] Patent Number: 6,047,961

[45] Date of Patent: Apr. 11, 2000

[54] SHEET SENSOR FOR USE WITH A DRUM

[75] Inventors: Willi Becker, Bammental; Karl-Heinz Helmstaedter, Sinsheim; Andreas Henn, Neckargemuend; Tobias Mueller, Hirschberg; Juergen Rautert; Andreas Schulz, both of Heidelberg; Josef Wehle, Gaiberg, all of Germany

[73] Assignee: Heidelberger Druckmaschinen AG, Heidelberg, Germany

[21] Appl. No.: 09/031,458

[22] Filed: Feb. 26, 1998

[30] Foreign Application Priority Data

Feb. 26, 1997 [DE] Germany ..... 197 07 657

[51] Int. Cl.[7] ..... B41J 29/18

[52] U.S. Cl. ..... 271/258.01; 400/708; 400/711

[58] Field of Search ..... 271/258.01, 262, 271/263, 258.02, 268.01, 275, 276, 277; 400/711, 708, 709, 706, 703; 270/60

[56] References Cited

U.S. PATENT DOCUMENTS

| | | | |
|---|---|---|---|
| 4,777,509 | 10/1988 | Komatsubara et al. | 271/275 X |
| 4,778,296 | 10/1988 | Takahashi | 400/708 |
| 4,867,592 | 9/1989 | Cranford | 400/709 |
| 5,598,201 | 1/1997 | Stodder et al. | 271/275 X |
| 5,725,321 | 3/1998 | Brannan et al. | 400/708 |
| 5,732,944 | 3/1998 | Mayer | 271/265.01 |
| 5,944,431 | 8/1999 | Becker et al. | 400/708 |

FOREIGN PATENT DOCUMENTS

| | | |
|---|---|---|
| 2659469A | 3/1976 | Germany . |
| 26 59 469 | 9/1977 | Germany . |
| 359203907A | 11/1984 | Japan . |
| 59-203907 | 11/1984 | Japan . |

*Primary Examiner*—Christopher P. Ellis
*Assistant Examiner*—Patrick Mackey
*Attorney, Agent, or Firm*—Kenyon & Kenyon

[57] ABSTRACT

A sheet sensor arrangement for a sheet printing machine and particularly for a turning device of a sheet printing machine, which comprises at least one hollow cylindrical drum (3; 4), which has a gripper system to transport and/or temporarily store individual sheets (5). A sensor arrangement which is not very susceptible to contamination and has a mechanically simple structure is comprised of the fact that the cylindrical wall of the drum (3; 4) has at least one opening which allows light to pass through, and that a sheet sensor is formed by a light barrier (9, 10, 11), which has a light beam which, in at least one angle position of the drum, is directed from the inside at the opening which allows light to pass through. In addition, a corresponding process for optical monitoring of sheets in a sheet printing machine is indicated.

20 Claims, 9 Drawing Sheets

SHEET SENSOR FOR USE WITH A DRUM

FIELD OF THE INVENTION

The present invention relates to a sheet sensor device for a sheet printing machine, which has a gripper system to transport and/or temporarily store individual sheets, as well as a method for optical monitoring of sheets in such a printing machine.

RELATED TECHNOLOGY

For sheet printing machines having front and back printing, there are turning devices which comprise a storage drum for temporary storage of sheets from a print unit for front page printing, as well as a turning drum, in order to transport a sheet that has been temporarily stored on the storage drum in the opposite transport direction, i.e. with the former back edge of the sheet forward, to a subsequent print unit for reverse page printing. The storage drum and the turning drum each have a gripper system for holding the sheet at its leading edge and trailing edge, respectively.

To check whether a sheet was correctly transferred in the turning device, there are various electropneumatic sheet sensors in the state of the art, for example sniffer pistons or inquiry suction devices, or optoelectrical sheet sensors, such as reflected light sensors which detect the presence of the leading edge or trailing edge of a sheet at one or more points in the turning device. If the sheet is not detected, printing is shut off.

All known sheet sensors have at least some of the following disadvantages.

For reliable operation, the sensor must be arranged relatively close to the sheet which passes it. Since the printed sheet side in front page printing faces outwardly on the storage drum, there is the risk that fresh printing ink will smear on the sensor, and this risk is all the greater the more the sheet is fluttering. Not only is the fresh printed image damaged by smearing, but also the sensor becomes dirty. Optoelectrical sensors, in particular, therefore require frequent cleaning. In order to prevent smearing, sheet guide plates with air support have been used. However, these increase the construction effort for producing the machine, without completely eliminating the problem of sensor contamination.

Electropneumatic sensors are less susceptible to contamination than optoelectrical sensors, but they are relatively complicated in mechanical terms. Since the response behavior of such sensors depends on the printing speed and the type of stock, frequent adjustments are also required.

Finally, the known sensors can frequently be installed only in a disadvantageous angle position, i.e. in a position in which incorrect sheet transfer is detected only at a relatively late point in time, so that printing is also shut off at a relatively late point in time.

SUMMARY OF THE INVENTION

The present invention relates to a sheet sensor device which does not have a negative influence on the sheet movement (smearing), which is not very susceptible to contamination, and which is relatively simple in mechanical terms, and with which a mis-fed sheet can be detected as early as possible.

The present invention therefore provides a sheet sensor arrangement for a sheet printing machine, which comprises at least one hollow cylindrical drum, which has a gripper system to transport and/or temporarily store individual sheets, characterized in that the cylindrical wall of the drum (3; 4) has at least one opening (17; 25) which allows light to pass through, and that a sheet sensor is formed by a light barrier (9, 10, 11; 13; 15, 16; 20, 21, 16; 22, 23, 16), which has a light beam (14; 18) which, in at least one angle position of the drum, is directed from the inside at the opening which allows light to pass through. Thus the sheet sensor device is one in which the cylindrical wall of the drum has at least one opening which allows light to pass through, and where a sheet sensor is formed by a light barrier, which has a light beam which, in at least one angle position of the drum, is directed from the inside at the opening which allows light to pass through.

The present invention takes advantage of the circumstance that inside a drum of the type used in a turning device, free space is available or can be made available through a suitable structure of the drum. The free space is used, according to the present invention, either to house a light source for the light beam in the drum, or to bring the light beam in from the side of the drum. Therefore the light source is protected against contamination in excellent manner. If the light barrier works with reflected light from the sheet, the receiver can also be housed inside the drum, and if a process with light passing through is used, the receiver can be arranged at a sufficient distance from the drum so that it is not sensitive to contamination in this case, either. Particularly in the latter case, a bundled beam of light is preferred, such as that produced by a laser.

Using the present invention, the location at which the sensor responds to a sheet can be located at practically any desired point within a turning device, for example at a suitable point on the circumference of a storage drum or turning drum, or at a point which the sheet passes when being transferred from the storage drum to the turning drum. Therefore the sensor can be installed in the most advantageous angle position for the application purpose in each instance.

In a preferred embodiment, the light beam is directed from a point inside the drum crosswise to the axis of the drum and outwardly, for example perpendicular to the drum axis, a light source or a light deflection system being located at the point from which the light beam proceeds. The light source or the light deflection system can receive current or light from outside the drum, via a path which essentially runs parallel to the axis of the drum. Alternatively, the light beam can be generated outside the drum and directed, at a slant from the inside, at the opening which allows light to pass through.

If the light source or the light deflection system is arranged centered on the axis of the drum, a light source or a light deflection system can be used which is attached to a holder device fixed in place on the machine, which holder device projects axially into the drum from one side of the drum. In addition, a light receiver can be attached on such a holder device, if reflected light from the inside of a sheet resting on the drum is used. The holder device, for example a lance attached on the outside on the machine frame, can pass through the center of a ring-shaped lateral bearing for the drum.

If a light deflection system is used, for example a mirror or a prism or an arrangement of several such elements, this can also be housed in the drum outside of the axis, as a rule in the vicinity of the opening which allows light to pass through. Since the electrical output signal of the light receiver must be queried only in a very small angle range of the drum rotation, the light of the light source in this angle range can be brought in via a channel in the drum, which preferably runs parallel to the axis of the drum.

The opening which allows light to pass through is preferably a hole or a slit in the wall of the drum, but can also be a window of a translucent material in the drum wall, for example. If the drum has a channel for bringing in light from the side, this can comprise either a cavity or a translucent material which has been integrated into the drum, for example a light guide rod.

It is understood that the light barrier can function not just with visible light, but also with infrared light or ultraviolet light. Accordingly, light is understood to mean all adjacent electromagnetic beams in the electromagnetic spectrum which can be used for sheet detection, similar to light.

The sensor arrangement according to the invention can be used not only for checking sheets, i.e. for checking whether a transported or temporarily stored sheet has been correctly taken up or given out by the drum, but also for a length inquiry, if a suitable arrangement is present, i.e. for checking whether a transported or temporarily stored sheet has the correct length.

The present invention can be used not only for monitoring purposes in the case of a sheet-turning device with a storage drum and a turning drum, but also in connection with any other drums in a sheet printing machine which transport or temporarily store sheets by means of grippers, in order to check correct gripping of the sheets or their length.

The present invention also provides a process for optical monitoring of sheets in a sheet printing machine, which comprises at least one hollow cylindrical drum with a gripper system to transport and/or temporarily store individual sheets, characterized in that the sheets (5) are monitored by a bundled light beam (14; 18) which is emitted from a point inside the drum (3; 4) and which, in at least one angle position of the drum, is aimed at an opening (17; 25) which allows light to pass through, formed in the wall of the drum.

BRIEF DESCRIPTION OF THE DRAWINGS

Further characteristics and advantages of the present invention are evident from the following description of several exemplary embodiments in which.

In the figures, the same or equivalent parts are indicated with the same reference symbols.

DETAILED DESCRIPTION

Figure 1:
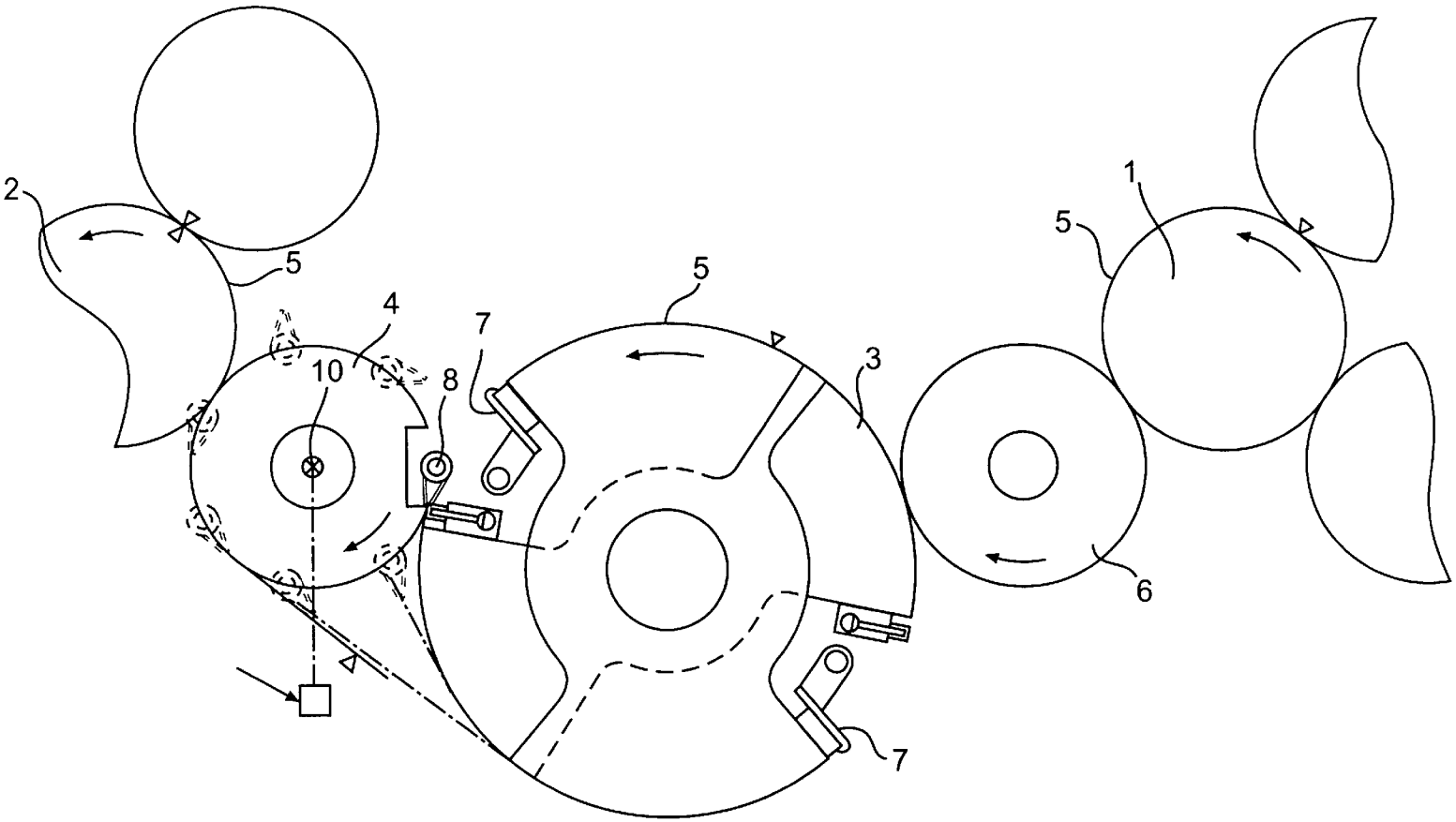
FIG. 1 shows a side view of a turning device in a sheet printing machine, with an optical sheet sensor for monitoring sheets using a light beam from the turning drum.

The turning device shown in FIG. 1 is part of a sheet printing machine with a print cylinder 1 for front page printing and a print cylinder 2 for reverse page printing. The turning device arranged between print cylinder 1 for front page printing and print cylinder 2 for reverse page printing comprises a storage drum 3 and a turning drum 4, arranged adjacent to the former. Storage drum 3 has approximately twice the diameter of print cylinders 1, 2 and turning drum 4.

Sheets 5 printed on print cylinder 1 are transported, via an intermediate cylinder 6, one after the other, to storage drum 3, on which the printed side of the sheet is toward the outside. While storage drum 3 turns, it holds the leading edge of sheet 5 tightly by means of grippers 7. After the trailing edge of sheet 5 has reached turning drum 4, it is seized by grippers 8 on turning drum 4 and pulled from storage drum 3 by turning drum 4, which rotates in the opposite direction from storage drum 3, the former trailing edge of sheet 5 becoming its leading edge. From turning drum 4, on which the printed side of sheet 5 is also on the outside, sheet 5 is passed to the print unit with print cylinder 2, at which reverse page printing takes place.

The directions of rotation of the individual drums and cylinders are shown with arrows in FIG. 1, and the printed sides of the sheet in each instance are indicated with triangles. Sheets 5 in various intermediate phases of turning are shown with dot-dash lines. Grippers 8 on turning drum 4 are shown with broken lines in various phases of rotation of turning drum 4.

Referring to FIG. 1 and to FIG. 2, which is a schematic perspective view of the turning device shown in FIG. 1, at a slant from above, a sheet sensor for the turning device will now be described. The sheet sensor comprises a light source 9 arranged laterally on the axis of turning drum 4, a mirror 10 arranged in the center of turning drum 4, and a light receiver 11, which is arranged at a distance from turning drum 4, on its periphery.

Light source 9 is a laser, for example, which emits light axially into turning drum 4, the axis of turning drum 4 being structured to be hollow towards light source 9. Mirror 10 is attached inside turning drum 4, in such a way that it rotates with the latter. Mirror 10 deflects the light beam from light source 9 transversely in the direction towards the cylindrical wall of turning drum 4, the light beam (shown with a broken line) always falling on the same point of the wall of turning drum 4, since mirror 10 rotates together with turning drum 4. At the point on which the light beam falls on the wall of turning drum 4, there is an opening which allows light to pass through, not shown, for example an opening or a translucent window in the wall.

In an inquiry position, in which the presence of the leading edge or former trailing edge of the sheet on turning drum 4 is queried, the light beam deflected by mirror 10 hits light receiver 11 if sheet 5 is missing, i.e. does not hit light receiver 11 if sheet 5 is located in the beam range. A very precise inquiry of the position of the leading edge of the sheet can take place, for example, in that the intensity of the electrical output signal of light receiver 11 is measured and compared with a reference value at which a sheet 5 in the correct position just partially interrupts the light beam.

Instead of light receiver 11, a reflector can also be used, which deflects the light beam via mirror 10 back to the axis of turning drum 4, where it can be detected either on the side of light source 9, or, if a suitable mirror or prism system is used as mirror 10, on the opposite side, through use of a light receiver.

Light source 9 and mirror 10 are attached at points in the printing machine at which there is no risk of contamination or smearing. Light receiver 11, in the arrangement shown in FIG. 1, can easily be arranged at a sufficient distance from sheet 5, and when using reflected light, as described above, it is located at a non-critical point on the axis of turning drum 4 in any case.

Figure 2:
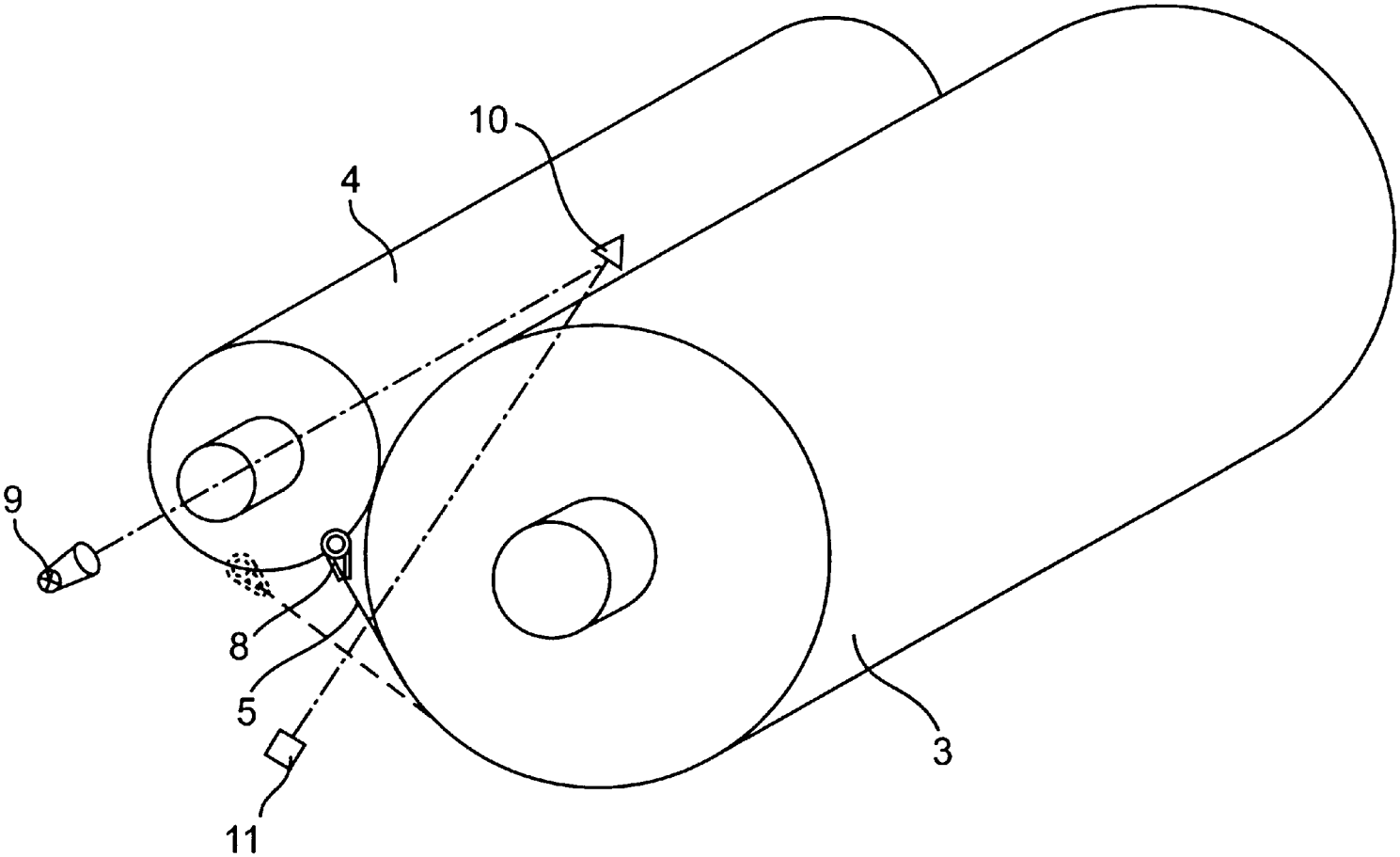
FIG. 2 shows a schematic perspective view of the turning drum and the storage drum of the turning device shown in FIG. 1.

As is evident from FIG. 1 and 2, there is a variety of possibilities for adjusting the angle position of light receiver 11 on the circumference of turning drum 4. When using reflected light, the angle position can actually be chosen in any desired manner. Light receiver 11, can therefore be arranged, without problems, in such a way that sheet monitoring and print shut-off, if necessary, can take place as early as possible, i.e. as early as necessary. Detection of mis-fed sheets is independent of speed, and no format adjustment to different sheet formats is required.

Since light either hits or does not hit light receiver 11 precisely once during every turn of turning drum 4, the output signal of light receiver 10 is very simple and can be processed in simple manner.

Through a suitable selection of the inquiry position on the circumference of turning drum 4, a length inquiry or length check of sheet 5 can be conducted as an alternative or in addition. Implementation of such a length inquiry will be explained in greater detail below.

Since the beam direction does not matter, light source 9 and light receiver 11 can also be interchanged.

Instead of only one opening which allows light to pass through, several openings which allow light to pass through, distributed over the wall of turning drum 4, can be used, the light beam being split in the center of turning drum 4. After the individual light beams have passed through the openings which allow light to pass through, they can be detected by separate light receivers. In this manner, several points on the sheet can be checked with a single light source.

Instead of conducting the light beam from light source 9 through the air into the center of turning drum 4, an axial light wave guide, directed at mirror 10, can also be used in turning drum 4.

In addition, instead of a rotating mirror 10, a fixed mirror can also be used, which is attached to a type of lance which projects into turning drum 4 on the axis of turning drum 4, from the side.

Furthermore, instead of light source 9 and mirror 10, a light source can be used which is attached to an axial lance through turning drum 4, and which emits light directly onto the opening in turning drum 4 which allows light to pass through. This will be explained in greater detail below, in connection with FIG. 3. The light source, which can be supplied with current via the lance, can be a light rod, for example, which emits an extended bundle of light onto an axis-parallel slit in turning drum 4.

In addition to the light source, a light receiver which receives or does not receive reflected light from the inside of a sheet resting on the turning drum can also be attached to such a lance which projects into turning drum 4. An exemplary embodiment of this will be described below, referring to FIG. 3, which is a schematic perspective view, at a slant from the bottom, of the turning device shown in FIG. 1, but without light receiver 11 arranged outside of turning drum 4.

Figure 3:
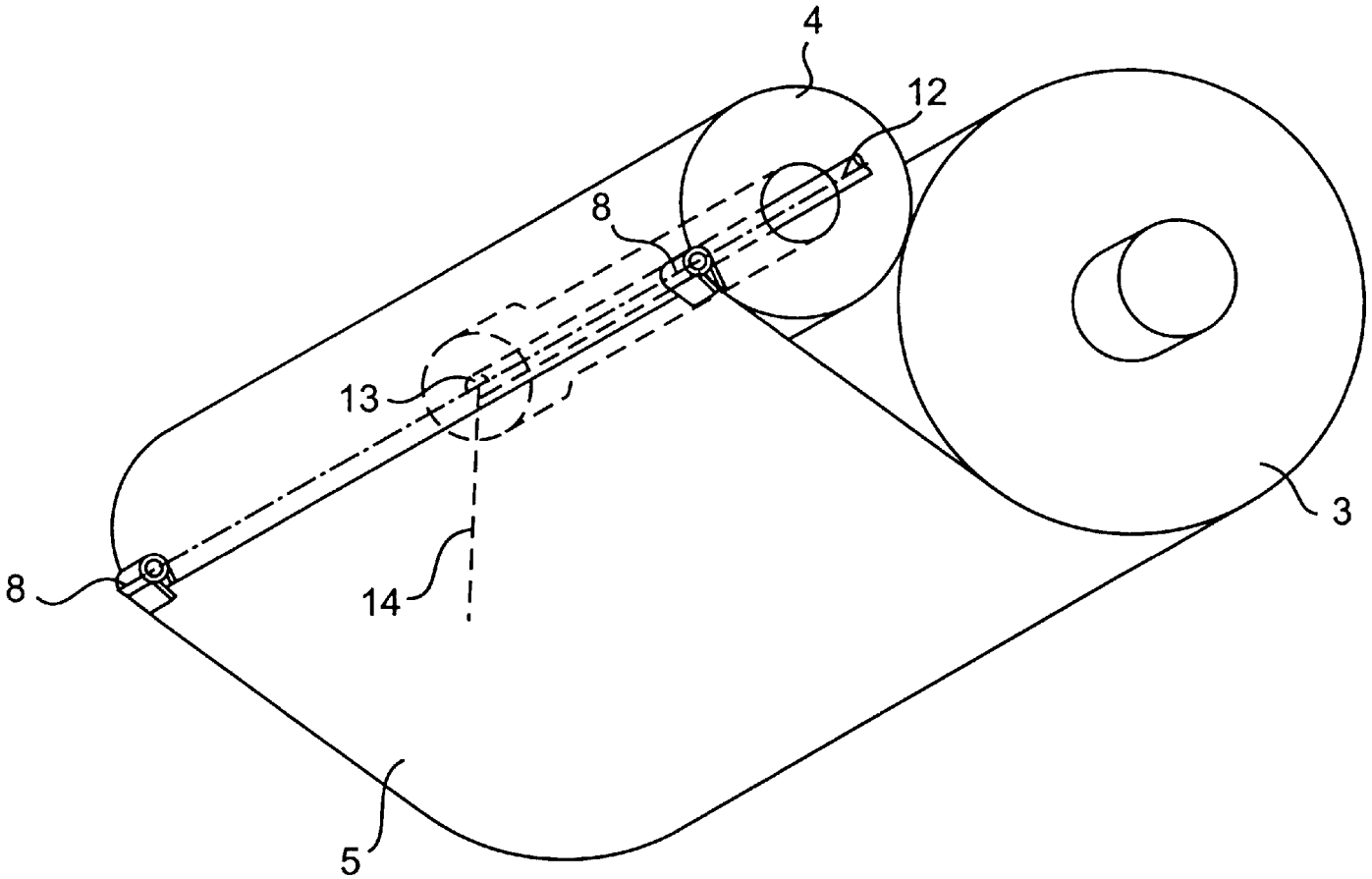
FIG. 3 shows a schematic perspective view of another exemplary embodiment of a turning device with an optical sheet sensor for monitoring sheets with a light beam from the turning drum.

A lance 12 attached to the printing machine, shown with a broken line in FIG. 3, projects axially into turning drum 4, which comprises an axial cavity for this purpose, which is accessible at least from that side of turning drum 4 on which lance 12 is attached to the printing machine. This can be achieved, for example, in that turning drum 4 is supported at least on this side using a ring bearing through which lance 12 extends. Lance 12 essentially has the shape of an extended pipe, its end which is located in the center of turning drum 4 being expanded to form a container in which a reflected light sensor 13 is located, i.e. a light source and a light receiver which are both aimed at an opening, not shown, in the wall of turning drum 4 which allows light to pass through; the edge of a sheet that has been correctly taken up by turning drum 4 is at this opening.

Instead of a hollow lance 12, any other lance in the form of an extended rod which extends into an axial cavity in turning drum 4 can also be used, of course. In such a case, the broken line designated with reference symbol 12 in FIG. 3 can be viewed as being the cavity.

Light beam 14 from the light source, shown with a broken line, preferably runs transversely to the axis of turning drum 4. The opening which allows light to pass through is, for example, a bore or a cast opening in the wall of turning drum 4. Cables, not shown, for the current supply to the light source and for receiving the signal from the light receiver, are passed out along the axis of turning drum 4 through lance 12.

As in the case of the exemplary embodiment described in connection with FIG. 2, the sensor arrangement shown in FIG. 3 can be used both for sheet monitoring and for a length inquiry, depending on its installed position. In addition to the advantages already described in connection with FIG. 2, the arrangement shown in FIG. 3 has the additional advantage that the light source and the light receiver are both arranged to be secure against contamination, being put out of adjustment, and mechanical damage, since they are not only located inside turning drum 4, but are additionally protected by hollow lance 12 in which they are installed.

In the exemplary embodiments described above, light source 9 and/or mirror 10 is arranged inside turning drum 4. In the following, exemplary embodiments will be described in which the light source or a light deflection system is arranged inside storage drum 3.

Figure 4:
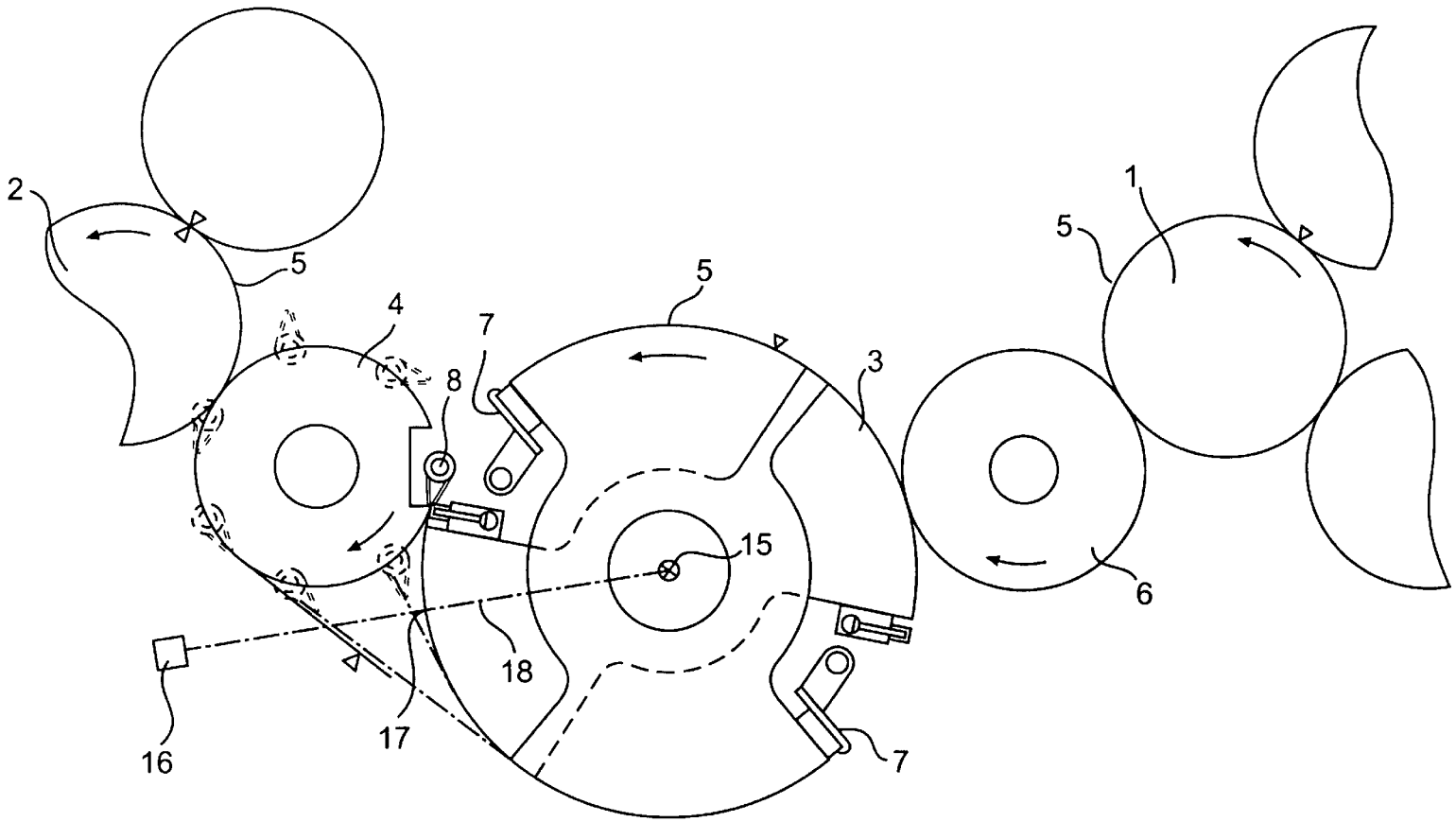
FIG. 4 shows a side view of a turning device in a sheet printing machine, with an optical sheet sensor for monitoring sheets by means of a light beam from the storage drum.
Figure 5:
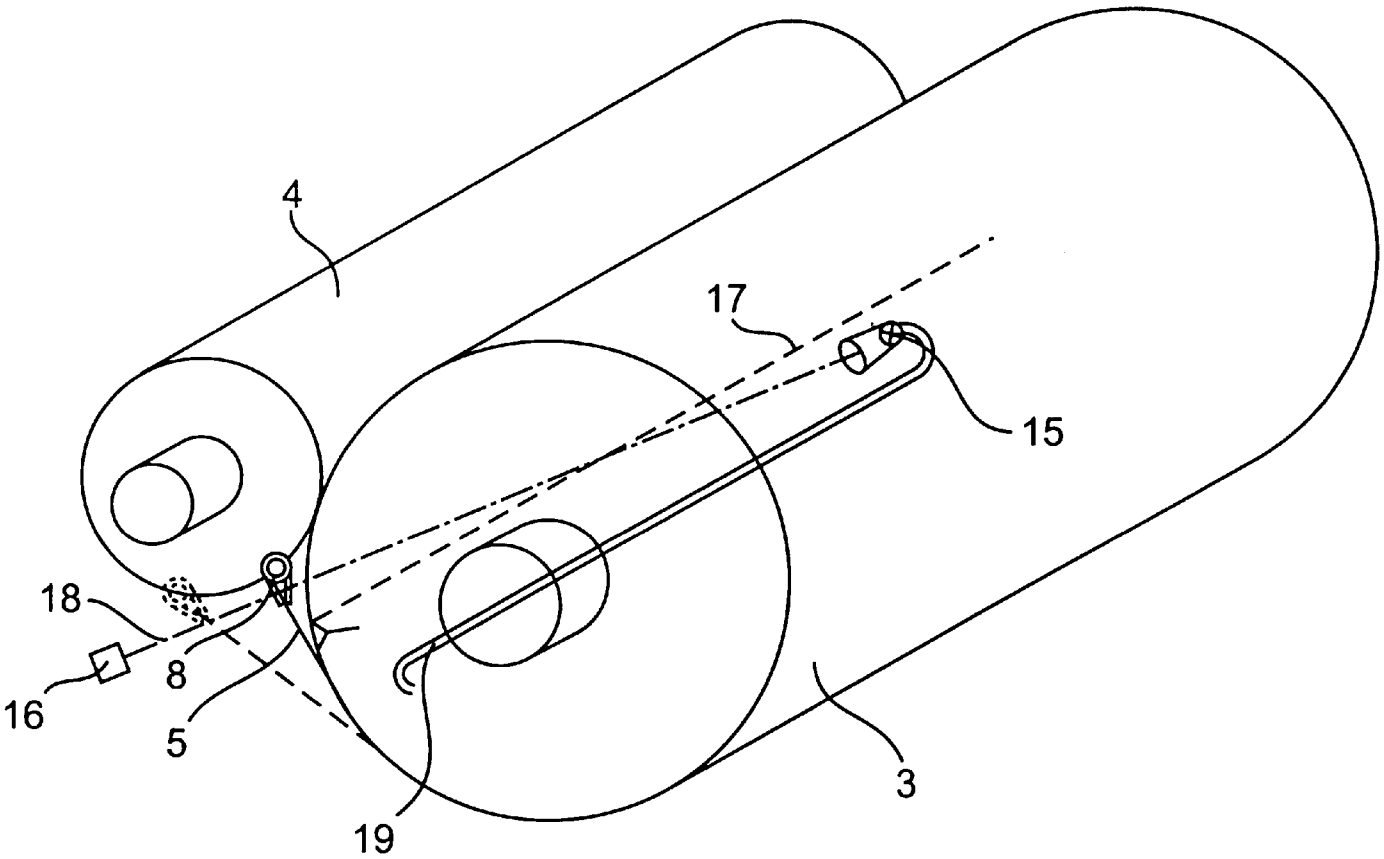
FIG. 5 shows a schematic perspective view of the turning drum and the storage drum of the turning device shown in FIG. 4.

FIGS. 4 and 5 show an exemplary embodiment of such a sensor arrangement. FIG. 4 shows the same turning device of a printing machine as FIG. 1, but a sheet sensor is formed by a light source 15 arranged in the center of storage drum 3 and by a light receiver 16 arranged at a distance from storage drum 3, affixed to a frame of the device. Light receiver 16 can be attached, for example, centered on the machine frame, if the beam is guided perpendicular to the axis of storage drum 3, or on the outside, on the side wall of the printing machine, if the beam is guided at a slant.

Light source 15 is a laser, a semiconductor light source, or an incandescent bulb with bundling optics, for example, and is held using a holder device which projects axially into storage drum 3, for instance by a type of lance as shown in FIG. 3, or by a holder rod which extends through all of storage drum 3, along the axis, and which is attached at both ends on the machine frame. The electrical energy to supply the light source is supplied via a cable 19 (see FIG. 5) which is laid along the axis of storage drum 3.

Referring to FIG. 5, a recess or opening, not shown, which allows light to pass through is formed in the cylindrical wall of storage drum 3. If storage drum 3 is located in a certain angle position, this opening which allows light to pass through makes it possible for light beam 18, shown with a broken line, from light source 15 to hit light receiver 16. Light source 15, light receiver 16, and the opening which allows light to pass through are arranged in such a way that light beam 18 aims at the former trailing edge, i.e. new leading edge 17 of a sheet 5, which has just been taken up by grippers 8 of turning drum 4. By assessing the output signal of the light receiver, it can be determined whether a sheet 5 is located in the beam range at the inquiry time, i.e. whether sheet 5 has been correctly transferred from storage drum 3 to grippers 8 of turning drum 4, or whether sheet 5 has remained behind on storage drum 3 because of a transfer error.

In a sensor arrangement as in FIG. 5, the light source can be affixed not inside storage drum 3, but, as an alternative, outside of it, similar to the sensor arrangements shown in FIG. 1 to 3. Such a case is shown in FIG. 6.

Figure 6:
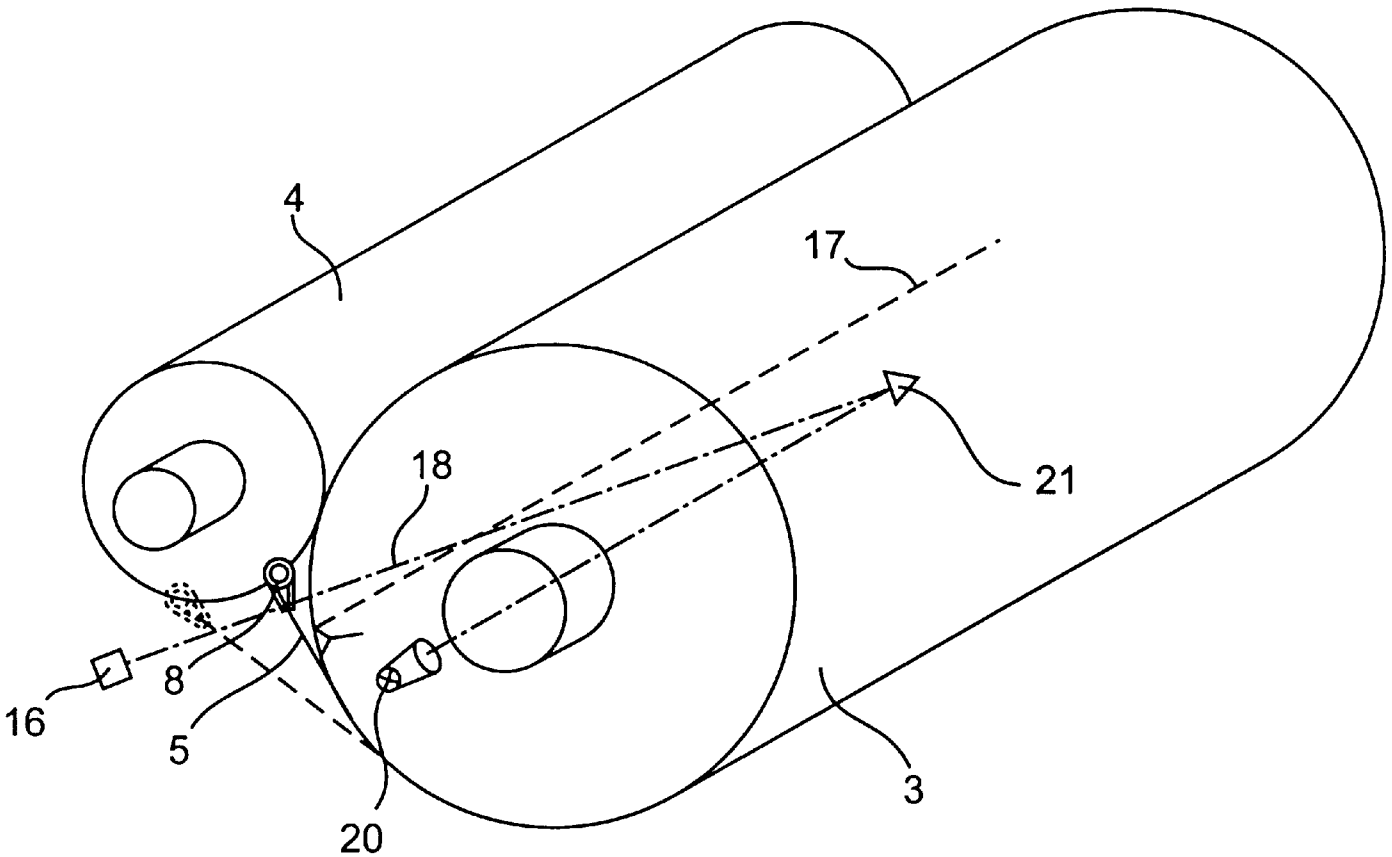
FIG. 6 shows a schematic perspective view of another exemplary embodiment for sheet monitoring using a light beam from the storage drum.

In FIG. 6, a light source 20 is arranged outside storage drum 3, on its axis, and emits light axially into storage drum 3. In the center of storage drum 3 there is a mirror 21, which deflects the light beam from light source 20 crosswise to the axis of storage drum 3. Mirror 21 can simply be attached to storage drum 3, so that it rotates together with the latter, in an angle position which is constant relative to storage drum 3 and which matches the arrangement of light receiver 16, or the opening, not shown, in the wall of storage drum 3 which allows light to pass through. Incidentally, the sensor arrangement shown in FIG. 6 is the same as that shown in FIG. 5, so that the light beam hits light receiver 16 if there is an incorrect sheet at the time of inquiry, and causes it to respond, if applicable.

Instead of passing the light beam to mirror 21 through the air, as shown in FIG. 6, a light wave guide, for example, can also be used, for example a fiberglass cable which is laid along the axis of storage drum 3.

Figure 7:
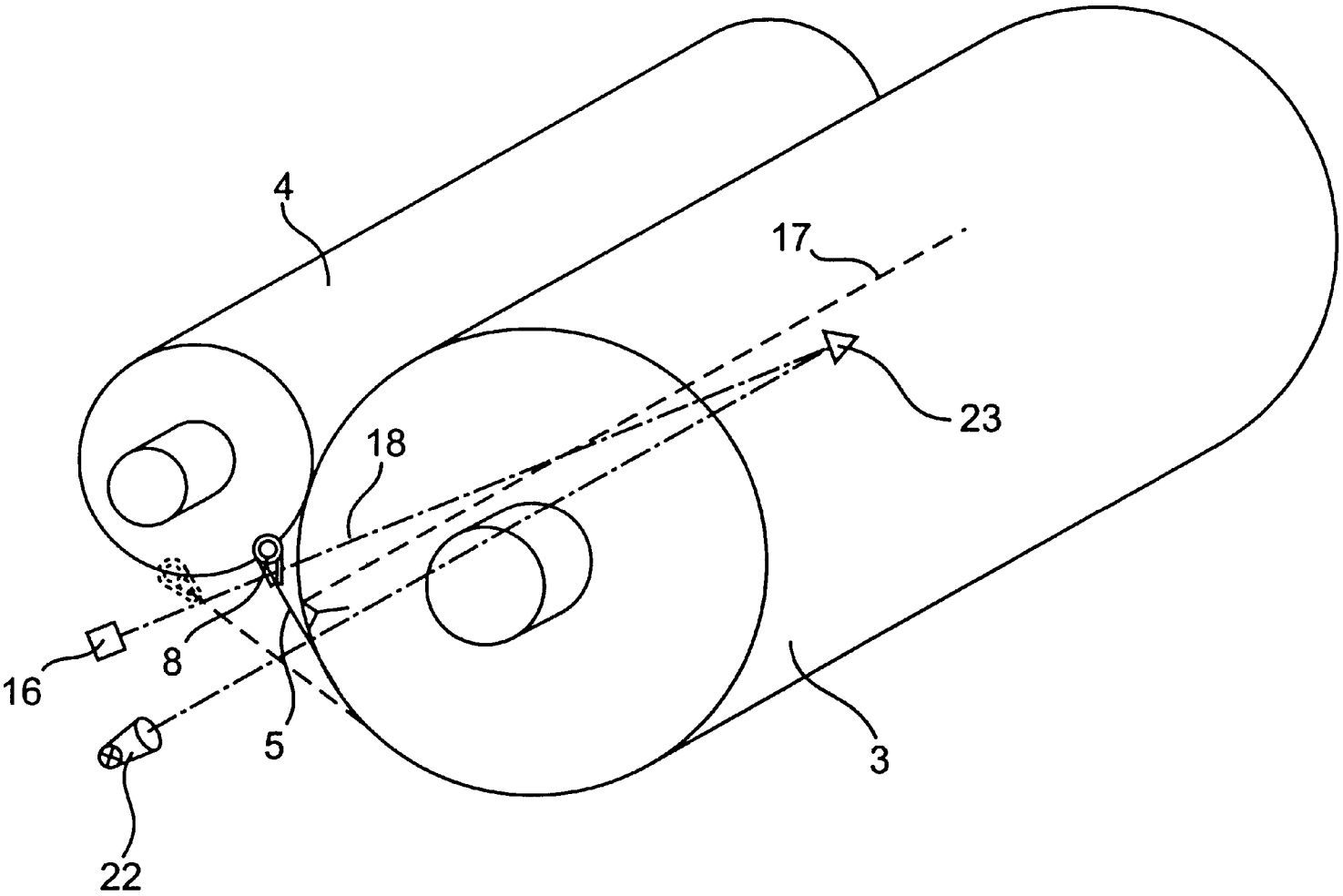
FIG. 7 shows a schematic perspective view of another exemplary embodiment for sheet monitoring using a light beam from the storage drum.

The arrangement shown in FIG. 7 differs from the sensor arrangement of FIG. 6 only in that instead of axial light source 20, a light source 22 is used, which is arranged at the side of storage drum 3, at a distance from the axis of storage drum 3 which is smaller than the radius of storage drum 3. Light source 22 emits light into storage drum 3 parallel to the axis, a channel, not shown, being formed in said storage drum 3. Via the inquiry window formed by the channel, the light beam, in the inquiry position, hits a mirror 23, which is attached in storage drum 3 at the same distance from the axis as light source 22, and deflects the light beam outwardly, similar to what is shown in FIG. 5 and 6.

Figure 8:
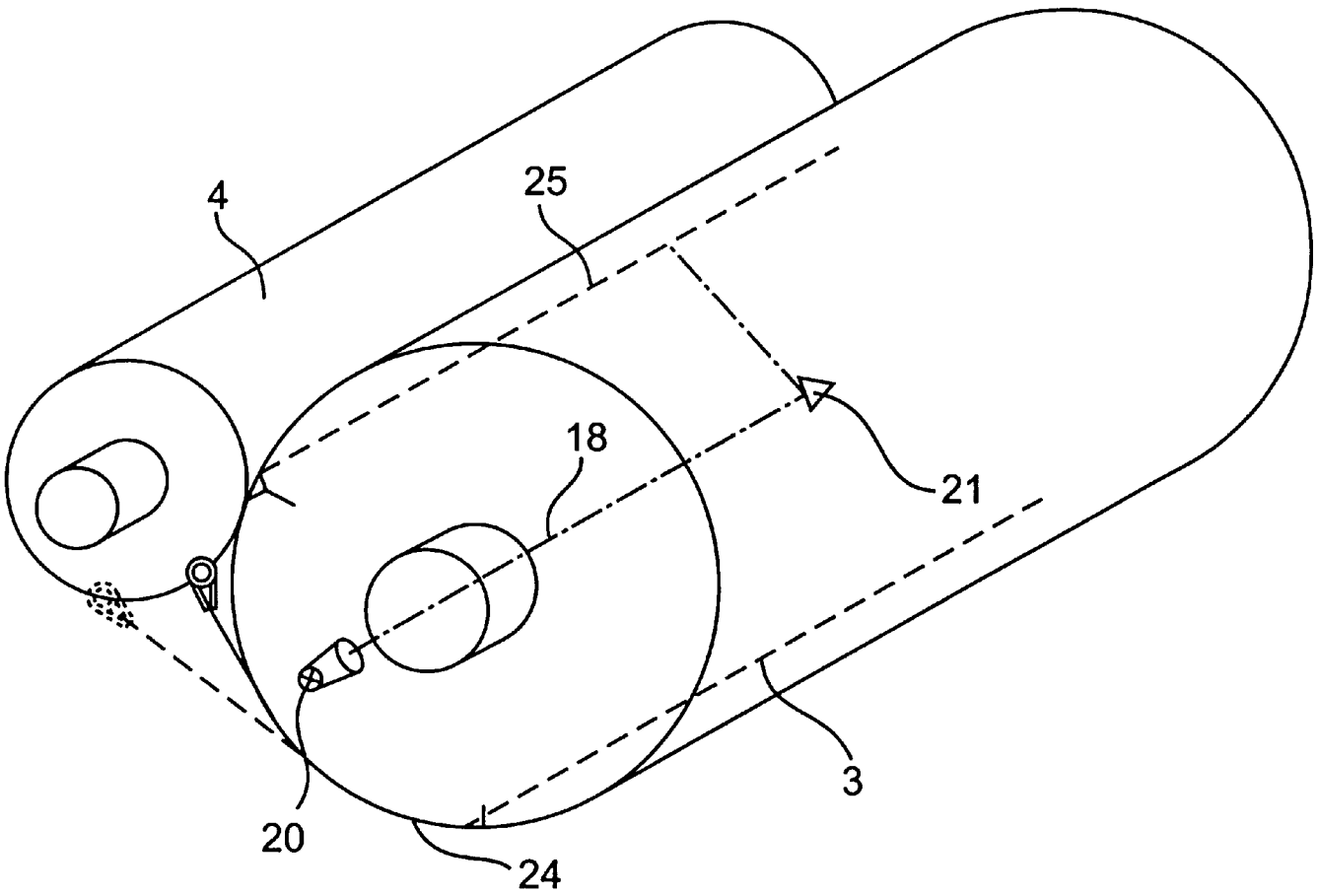
FIG. 8 shows a schematic perspective view of an exemplary embodiment for length monitoring using a light beam from the storage drum.
Figure 9:
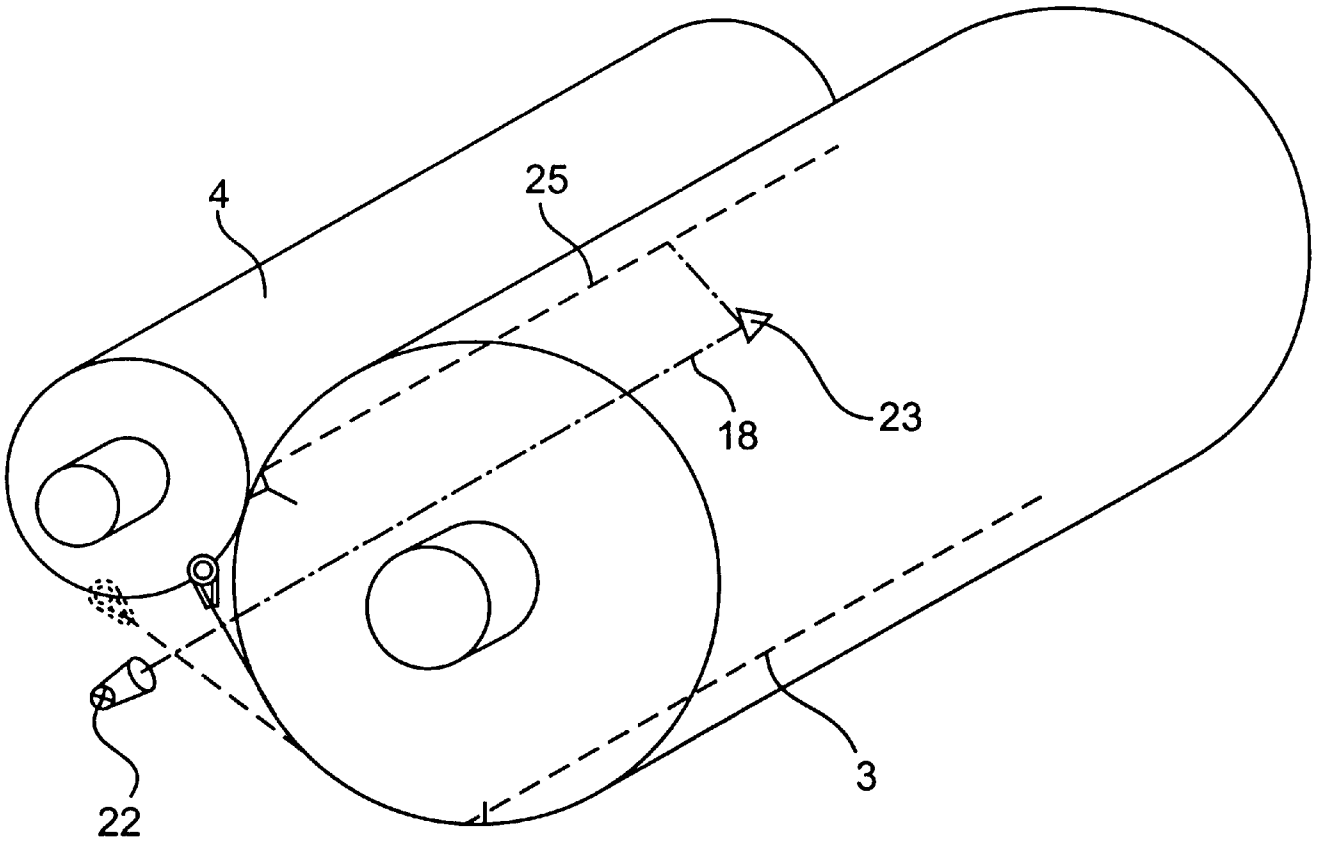
FIG. 9 shows a schematic perspective view of another exemplary embodiment for length monitoring using a light beam from the storage drum.

In the case of a suitable arrangement of the light source or the light deflection system on or in storage drum 3, a length inquiry can also be conducted. Exemplary embodiments of this are shown in FIG. 8 and 9, which are schematic perspective views of a turning device like shown in FIG. 6 and 7, but in which a length inquiry is conducted instead of a sheet check, in that trailing edge 25 of a sheet 24 located on storage drum 3 is queried before sheet 24 is transferred to turning drum 4. In FIG. 8 and 9, two later phases in terms of time are also shown, in which sheet 24 is just about to be transferred to turning drum 4. However, these phases are no longer relevant for the length inquiry.

The sensor arrangement of FIG. 8 differs from the arrangement shown in FIG. 6 in that the light beam from mirror 21 is deflected to a point on the circumference of storage drum 3 at which trailing edge 25 of a sheet 24 stored on storage drum 3 is located. A recess or opening, not shown, which allows light to pass through is formed for the light beam in the wall of storage drum 3 at a suitable location. The light beam is aimed at a light receiver, not shown, fixed in place on the frame, which is arranged at a distance from storage drum 3. A sheet which is too short can be detected using the output signal of the light receiver.

The sensor arrangement of FIG. 9 is similar to the arrangement shown in FIG. 8, but a light source 22 which is not arranged axially and a mirror 23 which is not arranged axially are used, similar to FIG. 7.

In order to implement a length check of a sheet held on the storage drum, not only a process in which light passes through, as described in FIG. 8 and 9, but also a process in which light is reflected can be used. For this purpose, it is practical to attach at least the light receiver and preferably also the light source, for example a light rod, inside storage drum 3, for example on an axial lance which projects into storage drum 3, as it was shown and described for a turning drum 4 in connection with FIG. 3.

A length check as in FIG. 8 and 9 can be carried out not only at storage drum 3, but also at turning drum 4, in analogous manner.

The different further developments and variants which were described in connection with FIG. 1 to 3 are analogously applicable to the sensor arrangements of FIG. 4 to 9. In addition, the different sensor arrangements described can be combined with one another in many different ways, in order to conduct several monitoring processes on a sheet.

Another possibility of combination comprises arranging the light source in storage drum 3, for example, and the light receiver in turning drum 4, or vice versa, openings which allow light to pass through and correspond with one another being formed in the cylindrical walls of storage drum 3 and turning drum 4. In this manner, light which passes through can also be used in those angle ranges at the circumference of storage drum 3 or turning drum 4 in which an external light receiver such as light receiver 11 in FIG. 1 and 2 cannot be arranged on the drum circumference. In order to reach these angle ranges, a slanted light beam which exits the drum at a slant to the side and there hits a light receiver attached on the side wall of the printing machine can also be used, as an alternative.

All the exemplary embodiments have the common feature that they are extremely insensitive to contamination, particularly due to smearing of fresh printing ink, in contrast to conventional optoelectrical sensor arrangements. Differing from electropneumatic sensor arrangements such as sniffer pistons, for example, the mis-fed sheet detection device according to the invention is independent of speed, does not have to be readjusted, and has a significantly simpler mechanical structure. In addition, an advantageous angle position for shutting off printing can be selected, and the maintenance and cleaning intervals can be lengthened by means of using self-calibrating sensors (self-test).

The light transmitter and receiver can be connected to a processor which checks whether a transported or temporarily stored sheet (5) was correctly picked up by the drum or given out by the drum, which checks whether a transported or temporarily stored sheet (5) has a correct length, and which further controls the printing machine.

What is claimed is:

1. A sheet sensor device for a sheet printing machine having at least one hollow cylindrical drum having a cylindrical wall and an inside, the drum having a gripper system to transport individual sheets, the sheet sensor device comprising:

a sheet sensor, the sheet sensor including a light transmitter inside the drum outputting a light beam, the cylindrical wall of the drum having at least one opening for allowing the light beam to pass through and the light beam being directed from the inside of the drum at the opening in at least one angle position of the drum;

a light source remote from the drum generating the light beam towards the light transmitter; and a light receiver remote from the drum receiving the light beam outputted by the light transmitter and transmitted through the at least one opening.

2. The sheet sensor device as recited in claim 1 wherein the light beam is directed from a point inside the drum and transverse to an axis of the drum to a second Point outside the drum.

3. The sheet sensor device as recited in claim 2 wherein the light transmitter is located at the point, the light transmitter including a light deflection system, the light transmitter receiving light from outside the drum, the light running via a path substantially parallel to the axis.

4. The sheet sensor device as recited in claim 3 wherein the light transmitter is centered on the axis.

5. The sheet sensor device as recited in claim 4 wherein the light transmitter is attached to a holder device fixed in place on the sheet printing machine, the holder device projecting from a side of the drum axially into the drum.

6. The sheet sensor device as recited in claim 3 wherein the light transmitter is a light deflection system arranged at a point between the axis and the cylindrical wall.

7. The sheet sensor device as recited in claim 6 wherein the light deflection system is attached to and rotates together with the drum.

8. The sheet sensor device as recited in claim 7 wherein the drum has at least one translucent channel which runs parallel to the axis, an inner end of the channel having a same distance from the axis as the light deflection system.

9. The sheet sensor device as recited in claim 6 wherein the light receiver is attached to the printing machine at a distance outside the drum.

10. The sheet sensor device as recited in claim 1 wherein the opening comprises at least one of a hole, a slit, and a window in the cylindrical wall of the drum.

11. The sensor device as recited in claim 1 wherein the light beam is one of infrared light, visible light, and ultraviolet light.

12. The sheet sensor device as recited in claim 1 wherein the light source is a laser.

13. The sheet sensor device as recited in claim 1 further comprising a processor connected to the sheet sensor for checking whether a transported sheet was correctly picked up or delivered by the drum.

14. The sheet sensor device as recited in claim 1 further comprising a processor connected to the sheet sensor for checking whether a transported sheet has a correct length.

15. The sheet sensor device as recited in claim 1 wherein the drum is a storage drum of a sheet turning device.

16. The sheet sensor device as recited in claim 1 wherein the drum is a turning drum of a sheet turning device.

17. A method for optical monitoring of individual sheets in a sheet printing machine having at least one hollow cylindrical drum with a gripper system, the method comprising the steps of:

transmitting a bundled light beam from a light source remote from the drum to a point inside the drum, the light beam being aimed in at least one angle position of the drum at an opening formed in a wall of the drum, the opening allowing light to pass through; and reflecting the light beam at the point, transmitting it through the opening, towards a light receiver remote from the drum.

18. The method as recited in claim 17 further comprising the step of determining whether one of the individual sheets was correctly picked up or delivered by the drum.

19. The method as recited in claim 17 further comprising the step of checking the length of one of the individual sheets.

20. The method as recited in claim 17 wherein the drum is a storage drum or a turning drum of a sheet turning device.

* * * * *